US006431263B2

(12) United States Patent
Oh et al.

(10) Patent No.: US 6,431,263 B2
(45) Date of Patent: Aug. 13, 2002

(54) HEAT EXCHANGER WITH SMALL-DIAMETER REFRIGERANT TUBES

(75) Inventors: Sai Kee Oh, Seoul; Dong Yeon Jang, Kyungki-do; Se Yoon Oh, Seoul; Wook Yong Lee, Kyungki-do, all of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/897,143

(22) Filed: Jul. 3, 2001

(30) Foreign Application Priority Data

Jul. 6, 2000 (KR) ..... 00-38505

(51) Int. Cl.[7] ..... F28D 1/04

(52) U.S. Cl. ..... 165/151; 165/181; 165/DIG. 503

(58) Field of Search ..... 165/151, 181, 165/182, DIG. 503

(56) References Cited

U.S. PATENT DOCUMENTS

| | | | | | |
|---|---|---|---|---|---|
| 3,397,741 | A | * | 8/1968 | Gunter | 165/151 |
| 4,593,756 | A | * | 6/1986 | Itoh et al. | 165/151 |
| 4,614,230 | A | * | 9/1986 | Sakuma et al. | 165/181 |
| 5,109,919 | A | * | 5/1992 | Sakuma et al. | 165/151 |
| 5,117,902 | A | * | 6/1992 | Kusuhara et al. | 165/151 |
| 5,642,777 | A | * | 7/1997 | Kang et al. | 165/151 |
| 6,026,893 | A | * | 2/2000 | Jung et al. | 165/181 |
| 6,050,328 | A | * | 4/2000 | Shikazono et al. | 165/181 |

* cited by examiner

*Primary Examiner*—Henry Bennett
*Assistant Examiner*—Terrell McKinnon
(74) *Attorney, Agent, or Firm*—Birch, Stewart, Kolasch & Birch, LLP

(57) ABSTRACT

A heat exchanger with small-diameter refrigerant tubes is disclosed. The heat exchanger has a plurality of air guide fins assembled with each other by one or more vertical rows of refrigerant tubes passing through the air guide fins. In the heat exchanger, each of the refrigerant tubes is a small-diameter tube having an outer diameter of not larger than 6 mm. In addition, four rows of offset surfaces are vertically formed on each of the air guide fins at a position between two tubes of each vertical row of refrigerant tubes through a pressing process such that the four rows of offset surfaces are arranged along a transverse direction of the fin. Four rows of vertical slits are each formed by two air guide openings defined between opposite side edges of each of the offset surfaces and the land surface of the air guide fin. In the heat exchanger, the number of the slits is reduced, in addition to changing the shape and dimension of the slits so as to allow the slits to be compatible with the small-diameter refrigerant tubes. The heat exchanger is also reduced in its production cost, accomplishes the recent trend of compactness, and minimizes its air-side pressure loss, in addition to accomplishing an improvement in its heat exchange operational performance due to its enhanced heat transfer efficiency. This heat exchanger is also improved in its productivity.

9 Claims, 8 Drawing Sheets

HEAT EXCHANGER WITH SMALL-DIAMETER REFRIGERANT TUBES

BACKGROUND OF THE INVENTION

1. Field of the Invention

The present invention relates to a heat exchanger with small-diameter refrigerant tubes and, more particularly, to a heat exchanger designed such that the number, shape and dimension of vertical slits formed on its air guide fins are optimally designed to be compatible with the small-diameter refrigerant tubes.

2. Description of the Prior Art

FIG. 1 is a perspective view of a conventional heat exchanger. FIG. 2 is a perspective view of a conventional air guide fin for such heat exchangers. FIG. 3 is a sectional view of the conventional air guide fin taken along the line A—A of FIG. 2.

As shown in FIG. 1, the conventional heat exchanger comprises a plurality of refrigerant tubes 1 and a plurality of air guide fins 3. The refrigerant tubes 1 form a refrigerant passage of the heat exchanger, while the air guide fins 3 are vertically arranged at regular intervals, with the linear parts of the refrigerant tubes 1 passing through the fins 3. The air guide fins 3 secure the heat exchange surface for allowing heat transfer between refrigerant and atmospheric air, and improve heat exchange efficiency of the heat exchanger.

In the conventional heat exchanger, the entire refrigerant tubes 1 are arranged relative to the air guide fins 3 to form two vertical rows of tubes: left- and right-hand vertical rows of tubes 1*a* and 1*b* as best seen in FIG. 1. Each of the air guide fins 3 thus has two vertical rows of tube-fitting openings 20 for allowing an installation of the tubes 1*a* and 1*b*.

As shown in FIGS. 2 and 3, each of the air guide fins 3 is typically provided with a plurality of vertical slits 10 for allowing air to pass through and enhancing the heat exchange efficiency of the heat exchanger.

In order to form the slits 10 on each air guide fin 3, the fin 3 is pressed at regularly spaced positions to form a plurality of offset surfaces 10*a* such that the offset surfaces 10*a* are alternately offset in opposite directions as best seen in FIG. 3. Two air guide openings are thus formed between opposite side edges of each offset surface 10*a* and the land surface of the fin 3, and allow air to smoothly pass through to improve heat exchange effect of the heat exchanger.

In a detailed description with reference to FIGS. 2 and 3, a set of vertical slits 10 are each vertically formed on the fin 3 at a position between two tube-fitting openings 20 of each vertical row of openings 20 through a pressing process. In such a case, six rows of vertical slits 10 are arranged in a transverse direction of the fin 3 at a position between the two tube-fitting openings 20. The slits 10 are formed by the air guide openings, each of which is defined between opposite side edges of each of the offset surfaces loa and the land surface of the air guide fin 3.

Of the six rows of vertical slits 10, the first, third and fifth rows of slits 11, 13 and 15 are formed by the upward offset surfaces 11*a*, 13*a* and 15*a*, while the second, fourth and sixth rows of slits 12, 14 and 16 are formed by the downward offset surfaces 12*a*, 14*a* and 16*a*. In such a case, the terms "upward offset" and "downward offset" are defined from FIG. 3 for ease of description. The first row of slits 11 comprise three unit slits vertically spaced apart from each other, while the second and sixth rows of slits 12 and 16 each comprise two unit slits vertically spaced apart from each other.

When the slits 10 are formed on each of the air guide fins 3 as described above, the slits 10 reduce the thickness of the thermal boundary layer inside the atmospheric air flowing along the fins 3, thus increasing the average heat transfer coefficient of air, and improving heat exchange operational performance of the heat exchanger.

The conventional heat exchanger is designed to use refrigerant tubes 1 having an outer diameter of 7 mm or 9.52 mm. In recent years, it is desired to reduce the outer diameter of the refrigerant tubes 1 in an effort to accomplish a preferable reduction in both the production cost and air-side pressure loss of heat exchangers. The refrigerant tubes 1 having such a reduced outer diameter are so-called "small-diameter refrigerant tubes" in the specification.

When a heat exchanger uses a plurality of small-diameter refrigerant tubes having a reduced outer diameter in place of conventional refrigerant tubes 1 having an outer diameter of 7 mm or 9.52 mm, it is necessary to optimally design the arrangement and shape of both the air guide fins 3 and the slits 10 so as to allow the fins 3 and the slits 10 to be compatible with the small-diameter tubes 1.

When a heat exchanger is fabricated using the small-diameter refrigerant tubes 1 and the air guide fins 3 without changing the arrangement and shape of the fins 3, it is almost impossible to form the slits 10 on the fins 3 since the widths of the slits 10 are extremely reduced as the width of the fins 3 is reduced due to the reduced outer diameter of the refrigerant tubes 1.

In the case of using such small-diameter refrigerant tubes 1 in a heat exchanger, the heat exchange efficiency of the air guide fins 3 may be deteriorated since the heat exchange surface area of each fin 3 is reduced due to a reduction in the width of the fin 3. In the prior art, such deterioration in the heat exchange efficiency of the fins 3 may be overcome by increasing the number of the air guide fins 3 per unit length of the refrigerant tubes 1 to compensate for the reduction in the heat exchange surface area of the fins 3. However, when a plurality of slits having the same arrangement and shape as those of the conventional slits 10 are formed on such fins 3, the air-side pressure loss of the heat exchanger is extremely increased to undesirably eliminate the advantages expected from the use of the small-diameter tubes as the refrigerant tubes.

That is, when a heat exchanger is fabricated using such small-diameter refrigerant tubes 1 while densely arranging the air guide fins 3 each having the six rows of vertical slits 10 in a conventional manner, the fins 3 undesirably increase resistance against air to overload a blower fan, thus damaging or breaking the blower fan.

Therefore, it is necessary to propose an air guide fin, which is preferably used in a heat exchanger having small-diameter refrigerant tubes, and of which the slits are appropriately arranged, shaped and sized to be compatible with the small-diameter refrigerant tubes.

SUMMARY OF THE INVENTION

Accordingly, the present invention has been made keeping in mind the above problems occurring in the prior art, and an object of the present invention is to provide a heat exchanger with small-diameter refrigerant tubes, of which the number, shape and dimension of vertical slits formed on the air guide fins are optimally designed to be compatible with the small-diameter refrigerant tubes, and which thus minimizes its airside pressure loss, in addition to accomplishing an improvement in the heat transfer efficiency of the fins.

In order to accomplish the above object, the present invention provides a heat exchanger, comprising a plurality of air guide fins securing a heat exchange surface for allowing heat transfer between refrigerant and atmospheric air and assembled with each other by one or more vertical rows of refrigerant tubes passing through the air guide fins, wherein each of said refrigerant tubes is a small-diameter tube having an outer diameter of not larger than 6 mm; and four rows of offset surfaces vertically formed on each of said air guide fins at a position between two tubes of each vertical row of refrigerant tubes through a pressing process such that the four rows of offset surfaces are arranged along a transverse direction of said fin, with four rows of vertical slits each formed by two air guide openings defined between opposite side edges of each of said offset surfaces and the land surface of the air guide fin.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
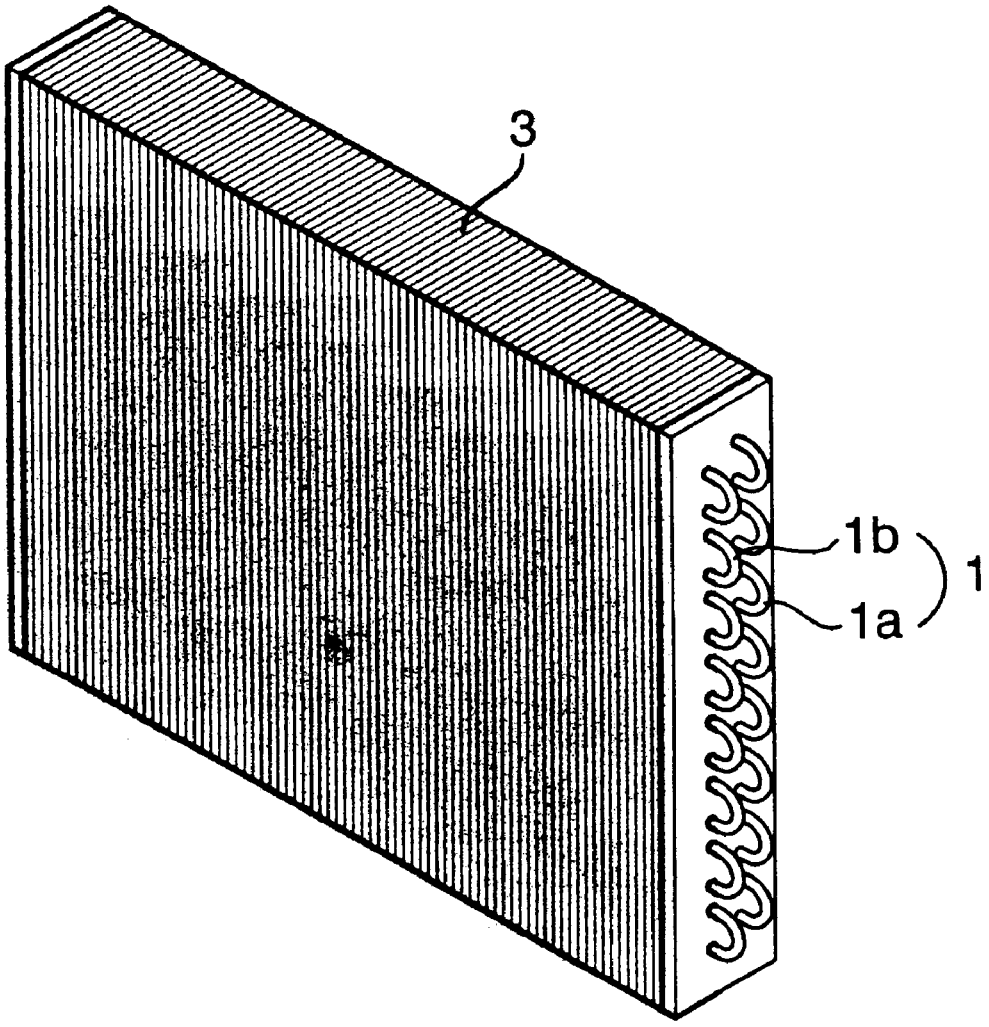
FIG.1(Prior Art)
FIG. 1 is a perspective view of a conventional heat exchanger.
Figure 2:
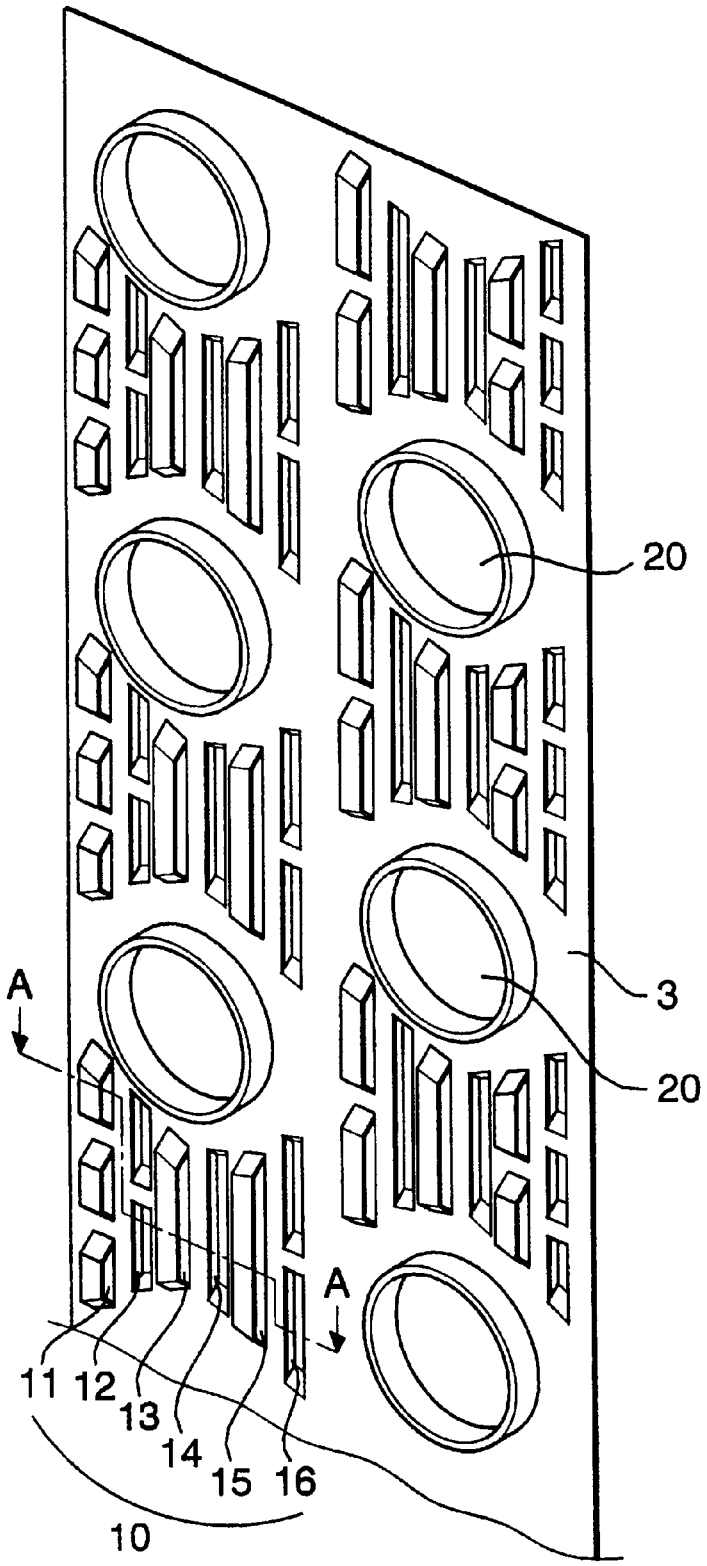
FIG.2(Prior Art)
FIG. 2 is a perspective view of a conventional air guide fin for such heat exchangers.
Figure 3:
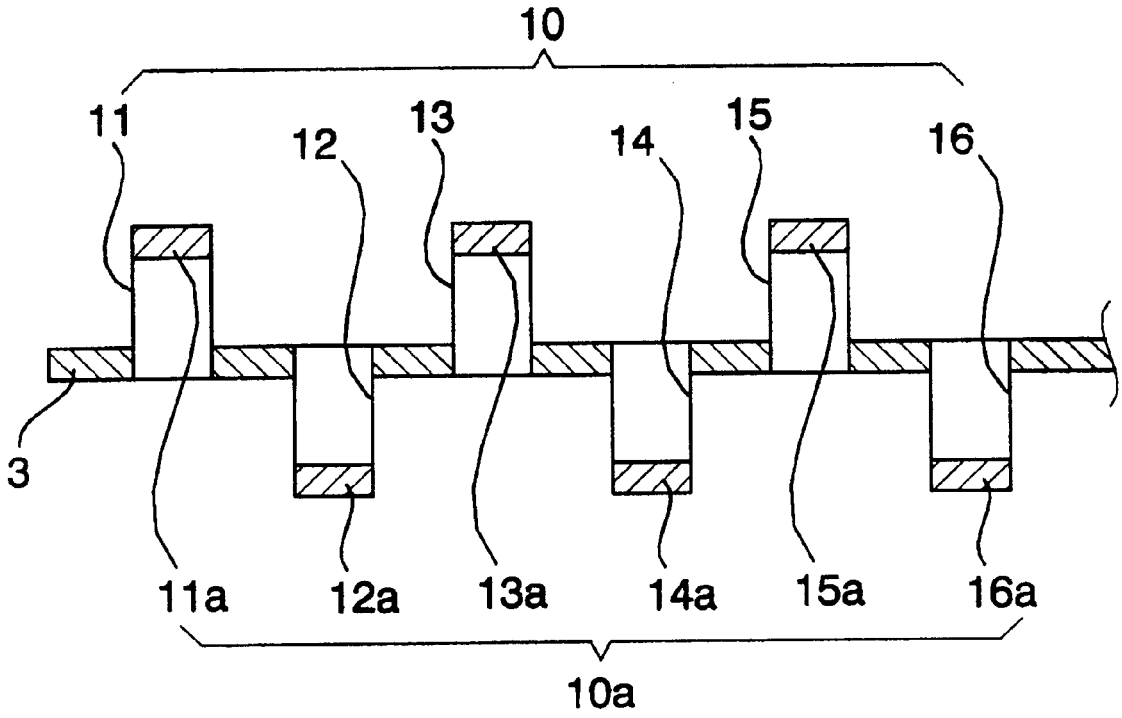
FIG.3 (Prior Art)
FIG. 3 is a sectional view of the conventional air guide fin taken along the line A—A of FIG. 2.

Reference now should be made to the drawings, in which the same reference numerals are used throughout the different drawings to designate the same or similar components.

Figure 4:
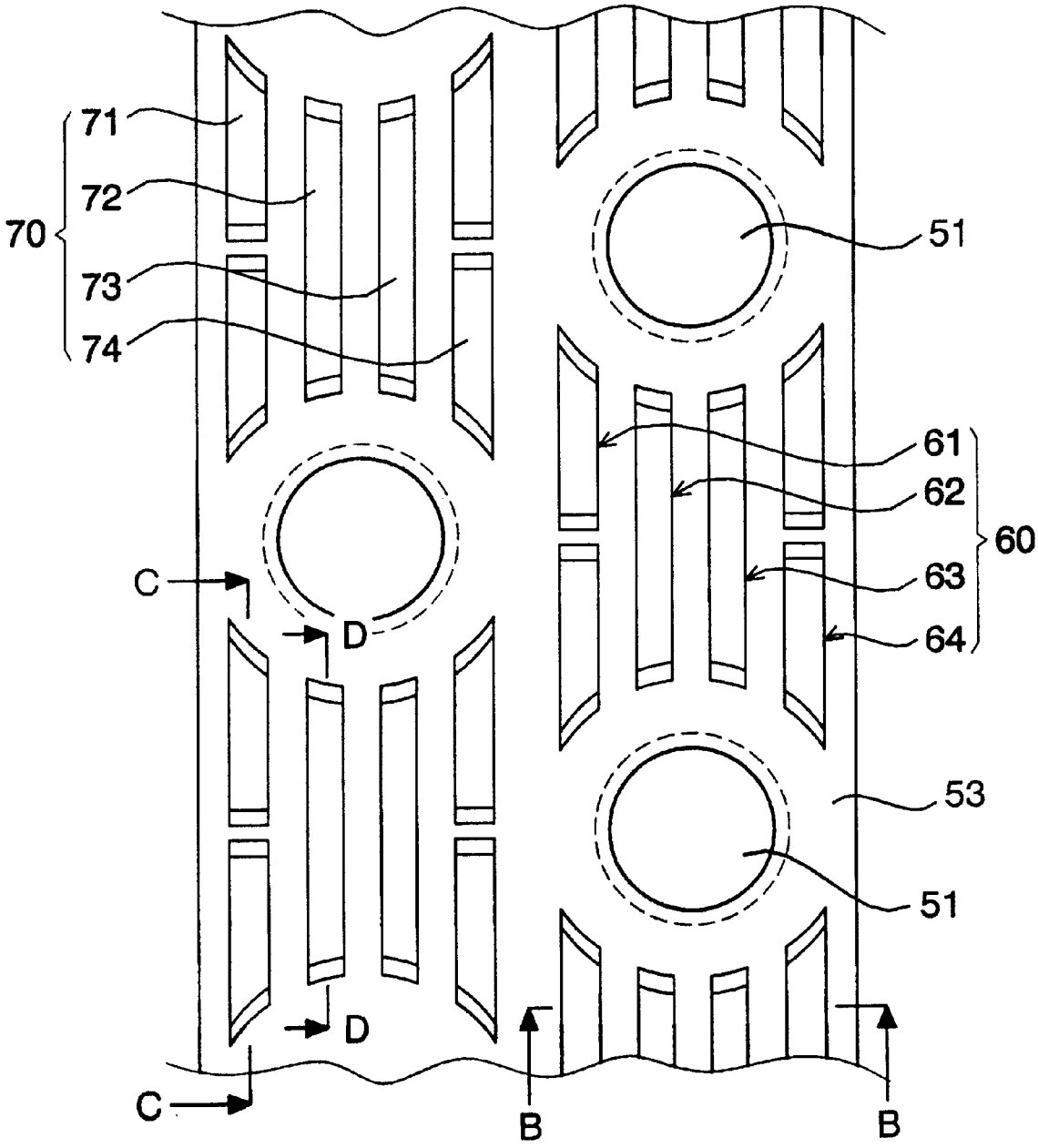
FIG. 4 is a plan view of an air guide fin included in a heat exchanger with small-diameter refrigerant tubes in accordance with the preferred embodiment of the present invention.
Figure 5:
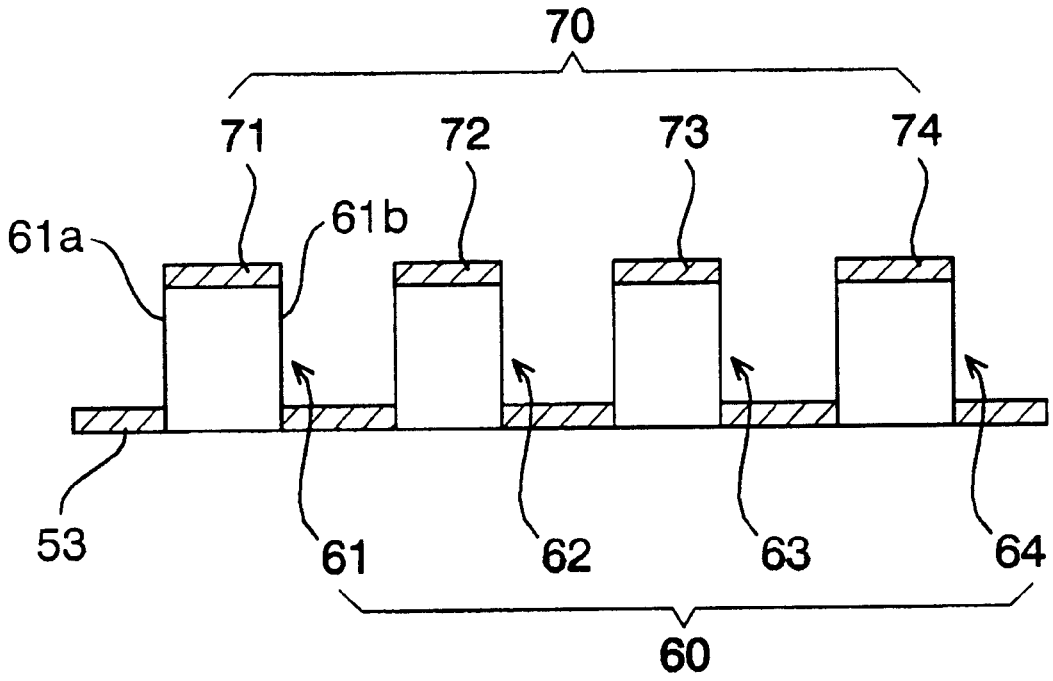
FIG. 5 is a sectional view of the air guide f in taken along the line B—B of FIG. 4.
Figure 6:
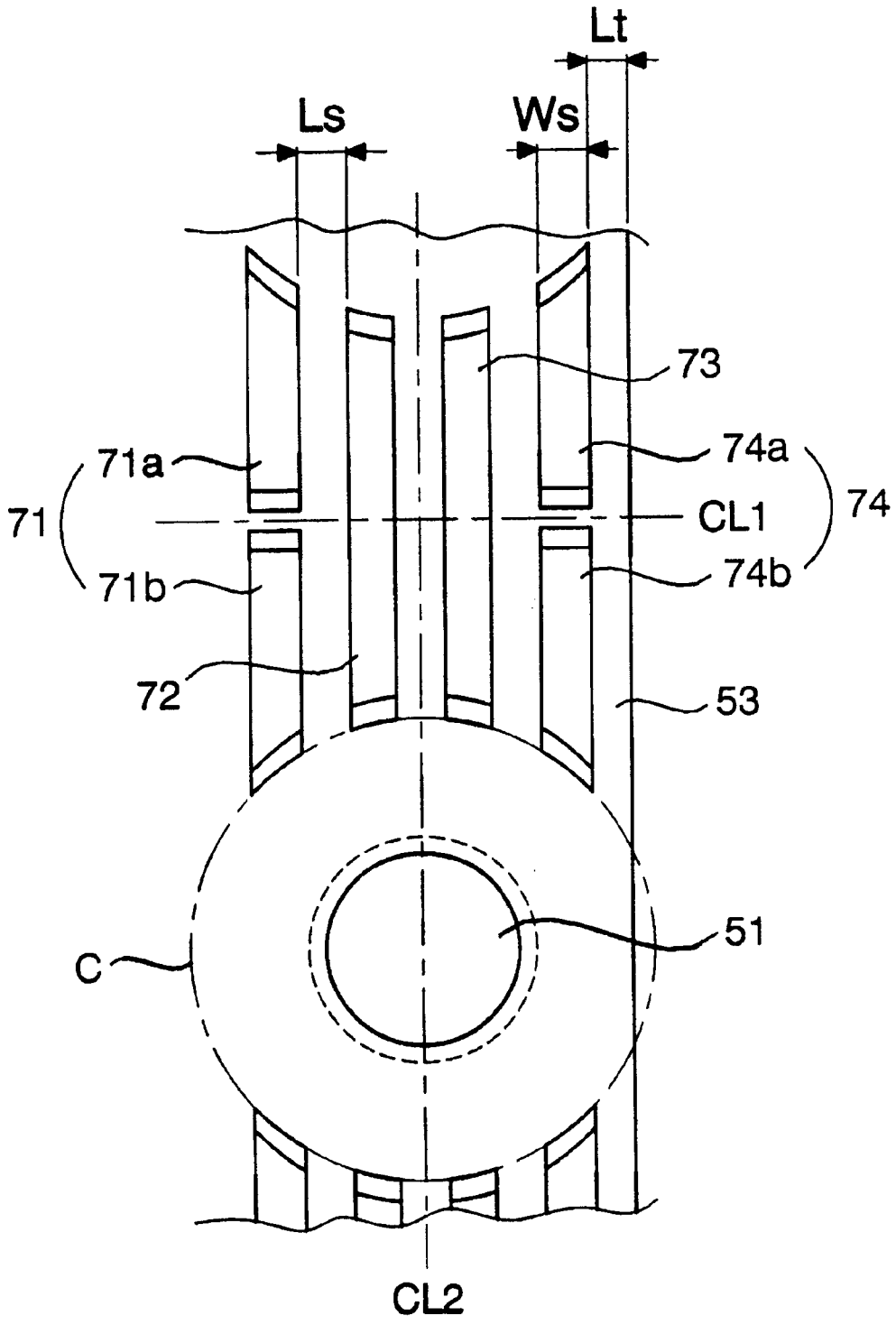
FIG. 6 is an enlarged plan view of the air guide f in of this invention.
Figure 7:
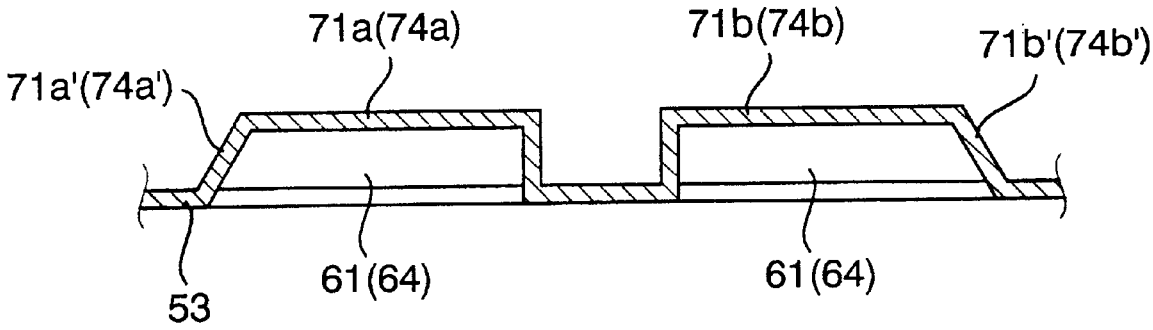
FIG. 7 is a sectional view of the air guide fin taken along the line C—C of FIG. 4.
Figure 8:
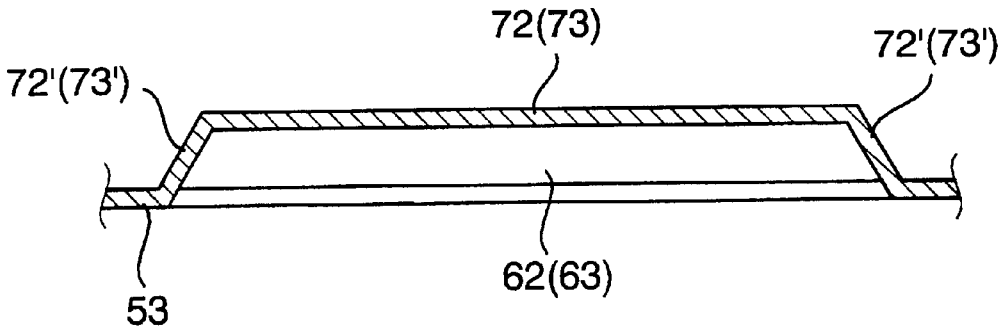
FIG. 8 is a sectional view of the air guide fin taken along the line D—D of FIG. 4.
Figure 9:
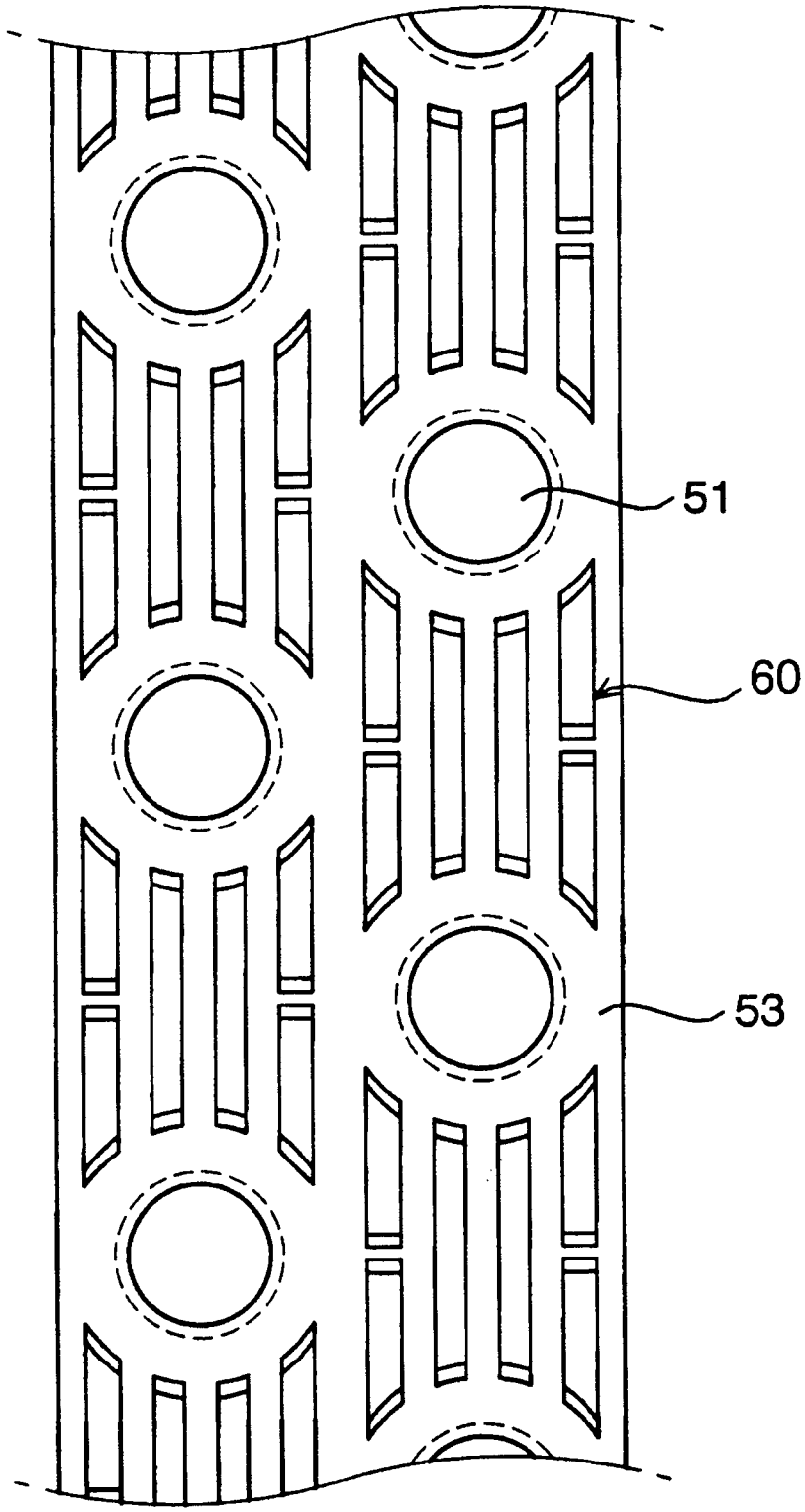
FIG. 9 is a plan view of an air guide fin having two rows of small-diameter refrigerant tubes in accordance with the present invention.

FIG. 4 is a plan view of an air guide fin included in a heat exchanger with small-diameter refrigerant tubes in accordance with the preferred embodiment of the present invention. FIG. 5 is a sectional view of the air guide fin taken along the line B—B of FIG. 4. FIG. 6 is an enlarged plan view of the air guide fin of this invention. FIG. 7 is a sectional view of the air guide fin taken along the line C—C of FIG. 4. FIG. 8 is a sectional view of the air guide fin taken along the line D—D of FIG. 4. FIG. 9 is a plan view of an air guide fin having two rows of small-diameter refrigerant tubes according to this invention.

As shown in FIGS. 4 to 6, the heat exchanger according to the present invention comprises a plurality of vertical rows of refrigerant tubes 51 and a plurality of air guide fins 53. The refrigerant tubes 51 form a refrigerant passage of the heat exchanger, while the air guide fins 53 are vertically arranged at regular intervals, with the linear parts of the refrigerant tubes 51 passing through the fins 53. The air guide fins 53 secure the heat exchange surface for allowing heat transfer between refrigerant and atmospheric air, and improve heat exchange efficiency of the heat exchanger. In the heat exchanger of this invention, each of the refrigerant tubes 51 is a small-diameter tube having an outer diameter of not larger than 6 mm. In addition, four rows of vertical slits 60 are formed on each of the air guide fins 53 at a position between two tubes of each vertical row of refrigerant tubes 51 such that the slits 60 are arranged along a transverse direction of the fin 53.

The slits 60 are formed as follows. That is, four rows of offset surfaces 70 are vertically formed on each of the air guide fins 53 at a position between two tubes of each vertical row of refrigerant tubes 51 through a pressing process such that the four rows of offset surfaces 70 are arranged along a transverse direction of the fin 53. The four rows of vertical slits 60 are each formed by two air guide openings defined between opposite side edges of each of the offset surfaces 70 and the land surface of the air guide fin 53. For example, the first row of slits 61 are formed by two air guide openings 61*a* and 61*b* defined between the opposite side edges of the offset surface 71 and the land surface of the air guide fin 53 as best seen in FIG. 5. Atmospheric air flow around the fins 53 under the guide of the slits 60, and so heat exchange effect of the heat exchanger is enhanced. Of the four rows of offset surfaces 70, the first and fourth rows of offset surfaces 71 and 74 each consist of two spaced unit offset surfaces, while the second and third rows of offset surfaces 72 and 73 each consist of a single unit offset surface.

In the present invention, the entire offset surfaces 70 having the slits 60 are offset from the land surface of the air guide fin 53 in the same direction. The unidirectionally offset structure of the surfaces 70 is caused by the fact that it is almost impossible to provide sufficient gaps for effectively forming oppositely offset surfaces between the fins 53 since the fins 53 in the heat exchanger having the small-diameter tubes 51 are densely arranged to leave narrow gaps of a small pitch between them due to the reduced diameter of the tubes 51.

As shown in FIG. 6, the outside end of each of the unit offset surfaces 71*a*, 71*b*, 74*a* and 74*b* of the first and fourth rows of offset surfaces 71 and 74 forming the slits 61 and 64 is inclined to be close to a transverse center-line "CL1" of the offset surfaces 70 in a direction toward a longitudinal center-line "CL2" of the offset surfaces 70.

In the preferred embodiment of this invention, the unit offset surfaces 71*a*, 71*b*, 74*a* and 74*b* are inclined only at their outside ends, but are horizontal at their inside ends, thus forming trapezoidal profiles when seeing them in a plan view as shown in FIG. 6. However, it should be understood that the unit offset surfaces 71*a*, 71*b*, 74*a* and 74*b* may be inclined at their inside and outside ends to form parallelogrammic profiles.

The opposite ends of each of the second and third offset surfaces 72 and 73 forming the slits 62 and 63 are inclined to be close to the transverse center-line "CL1" in the direction toward the longitudinal center-line "CL2", and so the second and third offset surfaces 72 and 73 thus form equiangular trapezoidal profiles. The four rows of offset surfaces 70 forming the slits 60 are symmetrically arranged on the basis of the longitudinal center-line "CL2".

In addition, the ends of the offset surfaces 70 with the slits 60 around each of the refrigerant tubes 51 form a trace circle "C", which is concentric with the refrigerant tube 51 and has a diameter of not larger than two times the outer diameter of each of the refrigerant tubes 51.

When the offset surfaces 70 around each of the refrigerant tubes 51 are designed to form such a trace circle "C", it is possible to more effectively guide air to the outer surfaces of the refrigerant tubes 51, thus more effectively promoting heat transfer between the air and the sidewalls of the tubes 51.

In addition, when the diameter of the trace circle "C" is limited to be not larger than two times the outer diameter of the refrigerant tube 51, it is possible to maintain appropriate gaps between the ends of the slits 60 and the outer surfaces of the tubes 51, in addition to securing desired sufficient lengths of the slits 60.

As shown in FIGS. 7 and 8, each of the offset surfaces 70 with the slits 60 comprises two rising parts 71*a*' and 71*b*', 72', 73' or 74*a*' and 74*b*' extending from the land surface of the fin 53, and a horizontal part 71*a*, 71*b*, 72, 73, 74*a* or 74*b* extending between the two rising parts. In such a case, the horizontal parts 71*a*, 71*b*, 72, 73, 74*a* and 74*b* of the offset surfaces 70 each form a desired slit 61, 62, 63 and 64 between it and the land surface of the fin 53. Each of the two rising parts 71*a*' and 71*b*', 72', 73' or 74*a*' and 74*b*' is inclined at a predetermined angle of inclination relative to the land surface of the air guide fin 53 for accomplishing smooth flow of air in the slits 60.

In addition, the fourth row of offset surfaces 74 positioned at the outermost edge of the slit arrangement are spaced apart from the outside edge of the air guide fin 53 by a gap "Lt" of 0.5 mm or more in an effort to allow a precise formation of the offset surfaces 70 and the slits 60 and protect a press machine during a process of forming the offset surfaces 70 and the slits 60.

The four rows of offset surfaces 70 have the same width "Ws", and are arranged at regular intervals.

In the heat exchanger of this invention, it is preferable to arrange two vertical rows of refrigerant tubes 51 on the air guide tubes 53.

When the two vertical rows of ref rigerant tubes 51 are arranged on the air guide tubes 53 as described above, it is preferable to form a zigzag arrangement of the tubes 51.

As described above, the present invention provides a heat exchanger with small-diameter refrigerant tubes. In the heat exchanger, the number of the vertical slits formed on each air guide fin is reduced, in addition to changing the shape and dimension of the slits so as to allow the slits to be compatible with the small-diameter refrigerant tubes. Therefore, the air guide fins of the heat exchanger are optimally compatible with the small-diameter refrigerant tubes. The heat exchanger is thus reduced in its production cost, accomplishes the recent trend of compactness, and minimizes its air-side pressure loss, in addition to accomplishing an improvement in its heat exchange operational performance due to its enhanced heat transfer efficiency. This heat exchanger is also improved in its productivity.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A heat exchanger, comprising a plurality of air guide fins securing a heat exchange surface for allowing heat transfer between refrigerant and atmospheric air and assembled with each other by one or more vertical rows of refrigerant tubes passing through the air guide fins, wherein each of said refrigerant tubes is a small-diameter tube having an outer diameter of not larger than 6 mm; and four rows of offset surfaces vertically formed on each of said air guide fins at a position between two tubes of each vertical row of refrigerant tubes through a pressing process such that the four rows of offset surfaces are arranged along a transverse direction of said fin, with four rows of vertical slits each formed by two air guide openings defined between opposite side edges of each of said offset surfaces and a land surface of the air guide fin.

2. The heat exchanger according to claim 1, wherein the entire offset surfaces are offset from the land surface of the air guide fin in the same direction.

3. The heat exchanger according to claim 1, wherein the first and fourth rows of offset surfaces each consist of two spaced unit offset surfaces, and the second and third rows of offset surfaces each consist of a single unit offset surface.

4. The heat exchanger according to claim 1, wherein opposite ends of each of said four rows of offset surfaces are inclined to be close to a transverse center-line of the offset surfaces in a direction toward a longitudinal center-line of the offset surfaces.

5. The heat exchanger according to claim 1, wherein said four rows of offset surfaces are symmetrically arranged on the basis of a longitudinal center-line thereof.

6. The heat exchanger according to claim 1, wherein the ends of the offset surfaces around each of said refrigerant tubes form a trace circle concentric with the refrigerant tube.

7. The heat exchanger according to claim 6, wherein said trace circle has a diameter of not larger than two times said outer diameter of each of said refrigerant tubes.

8. The heat exchanger according to claim 1, wherein each of said offset surfaces comprises two rising parts at opposite ends thereof, and a horizontal part extending between said two rising parts, each of said two rising parts being inclined at a predetermined angle of inclination relative to said land surface of the air guide fin.

9. The heat exchanger according to claim 1, wherein the fourth row of offset surfaces positioned around an outside edge of the air guide fin is spaced apart from said outside edge by a gap of 0.5 mm or more.

* * * * *